US010766065B2

(12) United States Patent
Tallman

(10) Patent No.: US 10,766,065 B2
(45) Date of Patent: Sep. 8, 2020

(54) METHOD AND ASSEMBLY FOR A MULTIPLE COMPONENT CORE ASSEMBLY

(71) Applicant: General Electric Company, Schenectady, NY (US)

(72) Inventor: James Albert Tallman, Glenville, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 293 days.

(21) Appl. No.: 15/240,606

(22) Filed: Aug. 18, 2016

(65) Prior Publication Data

US 2018/0050386 A1 Feb. 22, 2018

(51) Int. Cl.

| | |
|---|---|
| ***B22C 9/10*** | (2006.01) |
| ***B22C 9/24*** | (2006.01) |
| ***B28B 1/24*** | (2006.01) |
| ***B28B 11/24*** | (2006.01) |
| ***B22D 29/00*** | (2006.01) |
| ***B22C 21/14*** | (2006.01) |
| *B22C 7/02* | (2006.01) |
| *B22C 9/04* | (2006.01) |

(52) U.S. Cl.

CPC ..... *B22C 9/103* (2013.01); *B22C 9/108* (2013.01); *B22C 9/24* (2013.01); *B22C 21/14* (2013.01); *B22D 29/002* (2013.01); *B28B 1/24* (2013.01); *B28B 11/243* (2013.01); *B22C 7/02* (2013.01); *B22C 9/04* (2013.01)

(58) Field of Classification Search

CPC ..... B22C 9/10; B22C 9/103; B22C 9/108; B22C 9/04; B22C 9/24; B22C 21/14

USPC ..... 164/361, 365, 369, 370

See application file for complete search history.

(56) References Cited

U.S. PATENT DOCUMENTS

| | | | |
|---|---|---|---|
| 3,596,703 | A | 8/1971 | Bishop et al. |
| 4,487,246 | A | 12/1984 | Frasier |

(Continued)

FOREIGN PATENT DOCUMENTS

| | | | |
|---|---|---|---|
| EP | 3 184 197 | A1 | 6/2017 |
| JP | 2006-097608 | A | 4/2006 |

(Continued)

OTHER PUBLICATIONS

International Search Report and Written Opinion issued in connection with corresponding PCT Application No. PCT/US2017/044569, dated Oct. 12, 2017.

(Continued)

*Primary Examiner* — Kevin P Kerns

(74) *Attorney, Agent, or Firm* — Armstrong Teasdale LLP

(57) ABSTRACT

A component is formed from a component material introduced into a mold assembly. The mold assembly includes a mold that has a cavity defined therein by an interior wall. The cavity receives the component material in a molten state to form the component. A multiple component core assembly is positioned with respect to the mold and has a first core component attached to a second core component at a core split line. A core connection component is attached to each of the first and second core components at the core split line, such that the first core component is held adjacent the second core component at the core split line. The core connection component is formed from a connection component material that is at least partially absorbable by the component material.

14 Claims, 10 Drawing Sheets

(56) References Cited

U.S. PATENT DOCUMENTS

| | | | |
|---|---|---|---|
| 5,641,448 | A | 6/1997 | Yeung et al. |
| 6,186,217 | B1 | 2/2001 | Sikkenga et al. |
| 6,505,673 | B1 | 1/2003 | Abuaf et al. |
| 6,626,230 | B1 | 9/2003 | Woodrum et al. |
| 6,637,500 | B2 | 10/2003 | Shah et al. |
| 7,278,460 | B2 | 10/2007 | Grunstra et al. |
| 7,377,746 | B2 | 5/2008 | Brassfield et al. |
| 2017/0312815 | A1 | 11/2017 | Tallman et al. |
| 2017/0312816 | A1 | 11/2017 | Tallman et al. |

FOREIGN PATENT DOCUMENTS

| | | | |
|---|---|---|---|
| WO | 2004/033128 | A2 | 4/2004 |
| WO | 2015006479 | A1 | 1/2015 |

OTHER PUBLICATIONS

Tallman, J. A., et al., Methods for forming components using a jacketed mold pattern, GE Co-Pending U.S. Appl. No. 15/227,380, filed Aug. 3, 2016.

Liu et al., "Effect of nickel coating on bending properties of stereolithography photo-polymer SL5195",Materials & Design,vol. 26, Issue 6, pp. 493-496, 2005.

METHOD AND ASSEMBLY FOR A MULTIPLE COMPONENT CORE ASSEMBLY

BACKGROUND

The field of the disclosure relates generally to forming components via casting, and more particularly to forming a multiple component core assembly for casting such components.

Some known methods for manufacturing metallic components include casting. Some known casting methods facilitate the production of near net shaped components where the component is substantially formed in one step during the casting process and finish machined to complete the component. At least some components include intricately-shaped voids and internal passages and/or require an interior surface to be formed with particular features. For example, but not by way of limitation, some components, such as hot gas path components of gas turbines, are subjected to high temperatures. At least some such components have intricately-shaped internal voids defined therein, such as but not limited to a network of plenums and passages, to receive a flow of a cooling fluid adjacent an outer wall.

At least some such known components are formed in a mold with a core of ceramic material positioned within the mold cavity. A molten metal alloy is introduced to the mold cavity around the ceramic core and cooled to form the component. However, an ability to produce intricately-shaped voids and/or internal passages of the cast component depends on an ability to precisely form the intricate core and position it relative to the mold to define the cavity space between the core and the mold. In addition, at least some known ceramic cores are fragile, resulting in cores that are difficult and expensive to produce and handle without damage during the mold creation and casting process.

Alternatively or additionally, at least some known components are formed by drilling and/or otherwise machining the component to obtain the final shape, such as, but not limited to, using an electrochemical machining process. However, at least some such machining processes are relatively time-consuming and expensive. Moreover, at least some such machining processes cannot produce an outer wall having the features, wall thickness, shape, and/or contours required for certain component designs.

BRIEF DESCRIPTION

In one aspect, a mold assembly for forming a component from a component material is provided. The mold assembly includes a mold having an interior wall that defines a mold cavity within the mold. The mold cavity is configured to receive the component material in a molten state therein. The mold assembly also includes a core assembly that is positioned with respect to the mold. The core assembly includes a first core component, a second core component separate from the first core component, and a core connection component coupled to the first core component and the second core component. The first core component is coupled adjacent the second core component at a core split line defined therebetween. Additionally, the core connection component is formed from a connection component material that is configured to be absorbable by the component material.

In another aspect, a method of forming a component is provided. The method includes positioning a core assembly with respect to a cavity defined in a mold. The core assembly includes at least two separate core components, and a core connection component coupled to the at least two individual core components. The at least two individual core components are coupled to each other at a core split line defined therebetween. In addition, the method includes introducing a component material in a fluid state into the cavity, such that the core connection component is at least partially absorbed by the component material.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

The exemplary components and methods described herein overcome at least some of the disadvantages associated with known assemblies and methods for forming cast components. The embodiments described herein include separately forming at least two core components shaped to correspond to at least portions of an interior void of the component, and coupling the core components together using a core connection component. The pattern assembly is encased in a pattern material. The encased core assembly is used to fabricate a mold. The pattern material is removed to form a cavity within the mold. The component is cast in the mold cavity defined between the pattern assembly and the walls of the mold. When a molten or fluid component material is added to the mold, the core connection component is absorbed by the component material. The at least two core components are removed from the component to define the interior void of the component therein.

Figure 1:
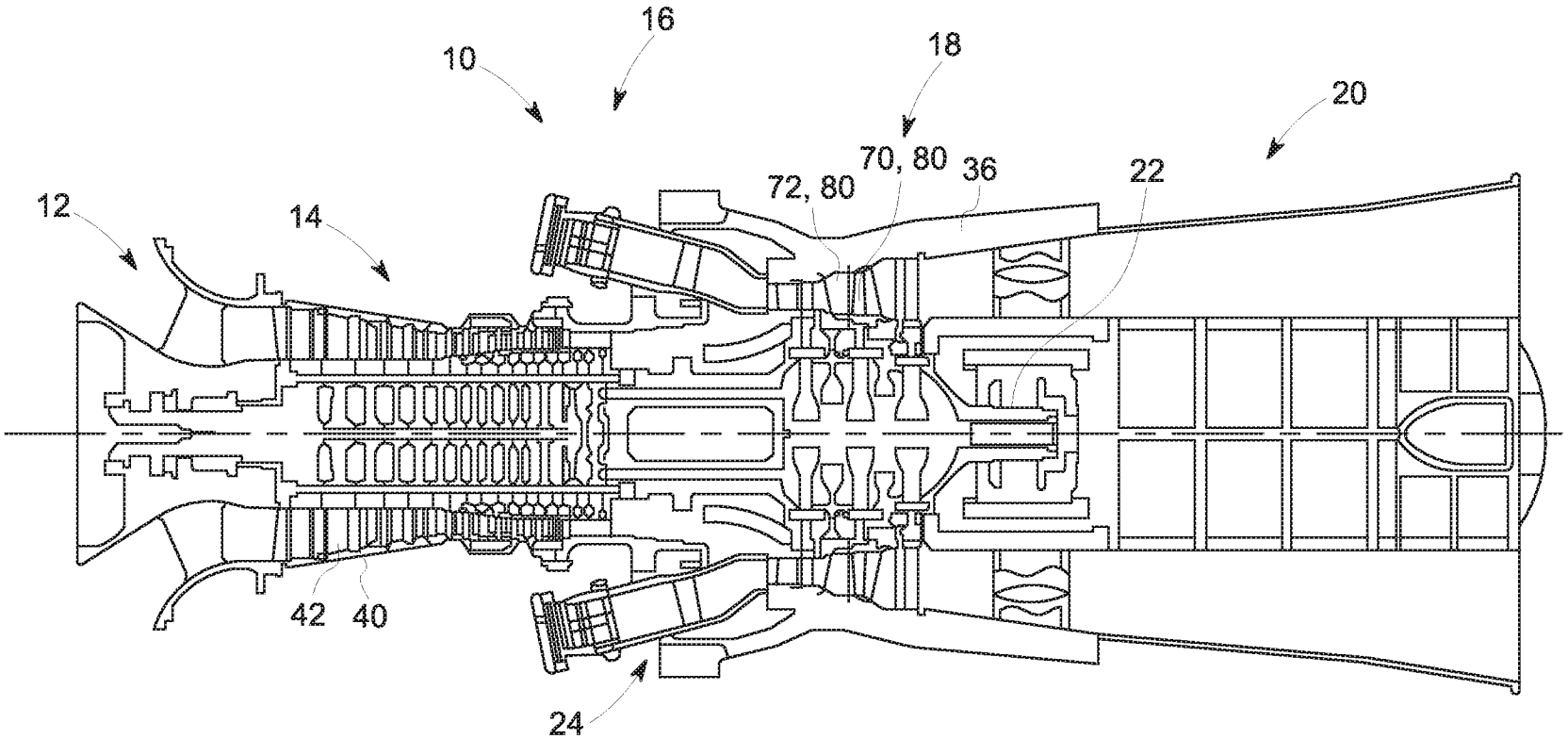
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 are designated as components 80. Components 80 proximate a path of the combustion gases are subjected to high temperatures during operation of rotary machine 10. Additionally or alternatively, components 80 include any component suitably formed as described herein.

Figure 2:
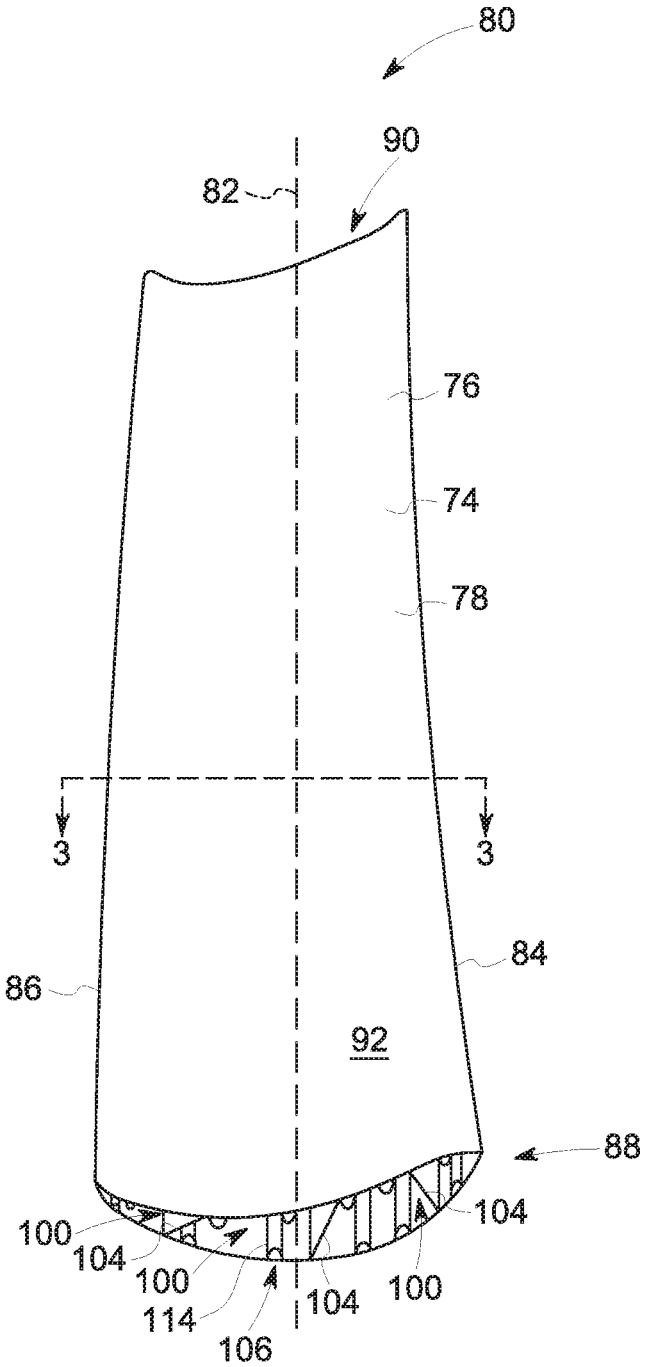
FIG. 2 is a schematic perspective view of an exemplary component for use with the rotary machine shown in FIG. 1.
Figure 3:
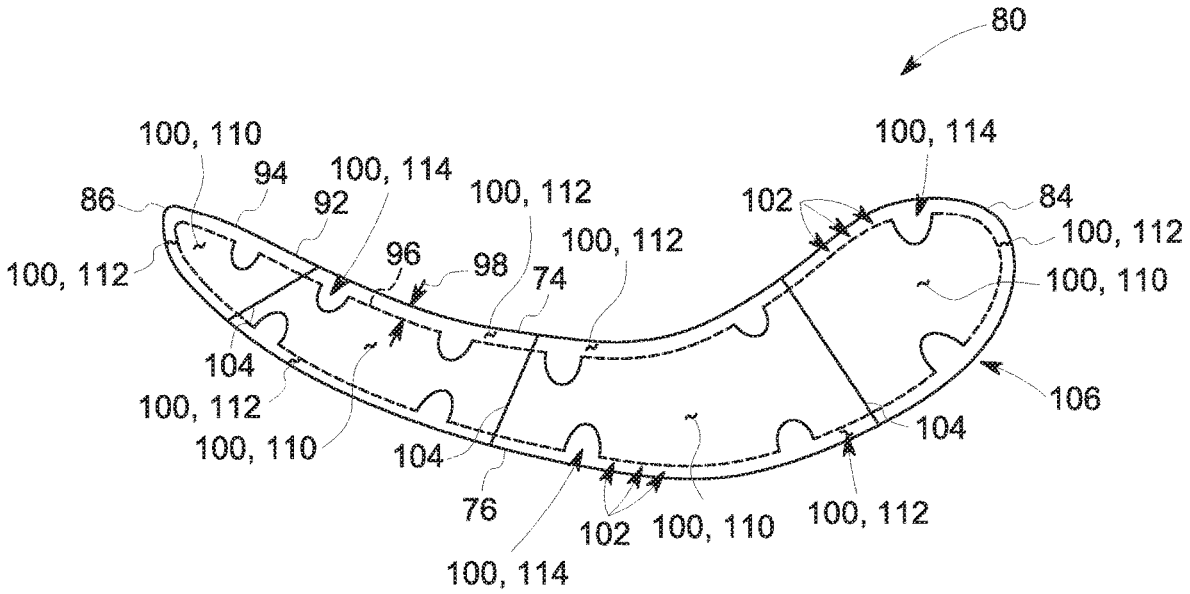
FIG. 3 is a schematic cross-section of the component shown in FIG. 2, taken along lines 3-3 shown in FIG. 2.

FIG. 2 is a schematic perspective view of an exemplary component 80, illustrated for use with rotary machine 10 (shown in FIG. 1). FIG. 3 is a schematic cross-section of component 80, taken along line 3-3 shown in FIG. 2. In the exemplary embodiment, component 80 includes an outer wall 94. Moreover, in the exemplary embodiment, component 80 includes at least one internal void 100 defined therein. For example, a cooling fluid is provided to internal void 100 during operation of rotary machine 10 to facilitate maintaining component 80 below a temperature of the hot combustion gases.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is any suitable material that enables component 80 to be formed as described herein.

In the exemplary embodiment, component 80 is one of rotor blades 70 or stator vanes 72. In alternative embodiments, component 80 is another suitable component of rotary machine 10 that is capable of being formed as described herein. In still other alternative embodiments, component 80 is any component for any suitable application that is suitably formed as described herein.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90. A longitudinal axis 82 of component 80 is defined between root end 88 and tip end 90. In alternative embodiments, rotor blade 70, or alternatively stator vane 72, has any suitable configuration that is capable of being formed as described herein.

Outer wall 94 at least partially defines an exterior surface 92 of component 80. In the exemplary embodiment, outer wall 94 extends circumferentially between leading edge 84 and trailing edge 86, and also extends longitudinally between root end 88 and tip end 90. In alternative embodiments, outer wall 94 extends to any suitable extent that enables component 80 to function for its intended purpose. Outer wall 94 is formed from component material 78.

In addition, in certain embodiments, component 80 includes an inner wall 96. Inner wall 96 is positioned interiorly to outer wall 94, and the at least one internal void 100 includes at least one plenum 110 that is at least partially defined by inner wall 96 and interior thereto. In the exemplary embodiment, each plenum 110 extends from root end 88 to proximate tip end 90. In alternative embodiments, each plenum 110 extends within component 80 in any suitable fashion, and to any suitable extent, that enables component 80 to be formed as described herein. In the exemplary embodiment, the at least one plenum 110 includes a plurality of plenums 110, each defined by inner wall 96 and at least one partition wall 104 that extends between pressure side 74 and suction side 76. In alternative embodiments, the at least one internal void 100 includes any suitable number of plenums 110 defined in any suitable fashion. Inner wall 96 is formed from component material 78.

Moreover, in some embodiments, at least a portion of inner wall 96 extends circumferentially and longitudinally adjacent at least a portion of outer wall 94 and is separated therefrom by an offset distance 98, such that the at least one internal void 100 also includes at least one chamber 112 defined between inner wall 96 and outer wall 94. In the exemplary embodiment, the at least one chamber 112 includes a plurality of chambers 112 each defined by outer wall 94, inner wall 96, and at least one partition wall 104. In alternative embodiments, the at least one chamber 112 includes any suitable number of chambers 112 defined in any suitable fashion. In the exemplary embodiment, inner wall 96 includes a plurality of apertures 102 defined therein and extending therethrough, such that each chamber 112 is in flow communication with at least one plenum 110.

In the exemplary embodiment, offset distance 98 is selected to facilitate effective impingement cooling of outer wall 94 by cooling fluid supplied through plenums 110 and emitted through apertures 102 defined in inner wall 96. For example, but not by way of limitation, offset distance 98 varies circumferentially and/or longitudinally along component 80 to facilitate local cooling requirements along respective portions of outer wall 94. In alternative embodiments, component 80 is not configured for impingement cooling, and offset distance 98 is selected in any suitable fashion that enables component 80 to function as described herein.

In certain embodiments, the at least one internal void 100 further includes at least one return channel 114 at least partially defined by inner wall 96. Each return channel 114 is in flow communication with at least one chamber 112, such that each return channel 114 provides a return fluid flow path for fluid used for impingement cooling of outer wall 94. In the exemplary embodiment, each return channel 114 extends from root end 88 to proximate tip end 90. In alternative embodiments, each return channel 114 extends within component 80 in any suitable fashion, and to any suitable extent, that enables component 80 to be formed as described herein. In the exemplary embodiment, the at least one return channel 114 includes a plurality of return channels 114, each defined by inner wall 96 adjacent one of chambers 112. In alternative embodiments, the at least one return channel 114 includes any suitable number of return channels 114 defined in any suitable fashion.

For example, in some embodiments, cooling fluid is supplied to plenums 110 through root end 88 of component 80. As the cooling fluid flows generally towards tip end 90, portions of the cooling fluid are forced through apertures 102 into chambers 112 and impinge upon outer wall 94. The used cooling fluid then flows into return channels 114 and flows generally toward root end 88 and out of component 80. In some such embodiments, the arrangement of the at least one plenum 110, the at least one chamber 112, and the at least one return channel 114 forms a portion of a cooling circuit of rotary machine 10, such that used cooling fluid is returned to a working fluid flow through rotary machine 10 upstream of combustor section 16 (shown in FIG. 1). Although impingement flow through plenums 110 and chambers 112 and return flow through channels 114 is described in terms of embodiments in which component 80 is rotor blade 70 and/or stator vane 72, it should be understood that this disclosure contemplates a cooling circuit 106 of plenums 110, chambers 112, and return channels 114 for any suitable component 80 of rotary machine 10, and additionally for any suitable component 80 for any other application suitable for closed circuit fluid flow through a component. Such embodiments provide an improved operating efficiency for rotary machine 10 as compared to cooling systems that exhaust used cooling fluid directly from component 80 into the working fluid within turbine section 18.

In alternative embodiments, the at least one internal void 100 does not include return channels 114. For example, but not by way of limitation, outer wall 94 includes openings extending therethrough (not shown), and the cooling fluid is exhausted into the working fluid through the outer wall openings to facilitate film cooling of exterior surface 92. In other alternative embodiments, component 80 includes both return channels 114 and openings (not shown) extending through outer wall 94, a first portion of the cooling fluid is returned to a working fluid flow through rotary machine 10 upstream of combustor section 16 (shown in FIG. 1), and a second portion of the cooling fluid is exhausted into the working fluid through the outer wall openings to facilitate film cooling of exterior surface 92.

Although the at least one internal void 100 is illustrated as including plenums 110, chambers 112, and return channels 114 for use in cooling component 80 that is one of rotor blades 70 or stator vanes 72, it should be understood that in alternative embodiments, component 80 is any suitable component for any suitable application, and includes any suitable number, type, and arrangement of internal voids 100 that enable component 80 to function for its intended purpose.

In some embodiments, apertures 102 each have a substantially circular cross-section. In alternative embodiments, apertures 102 each have a substantially ovoid cross-section. In other alternative embodiments, apertures 102 each have any suitable shape that enables apertures 102 to function as described herein.

Figure 4:
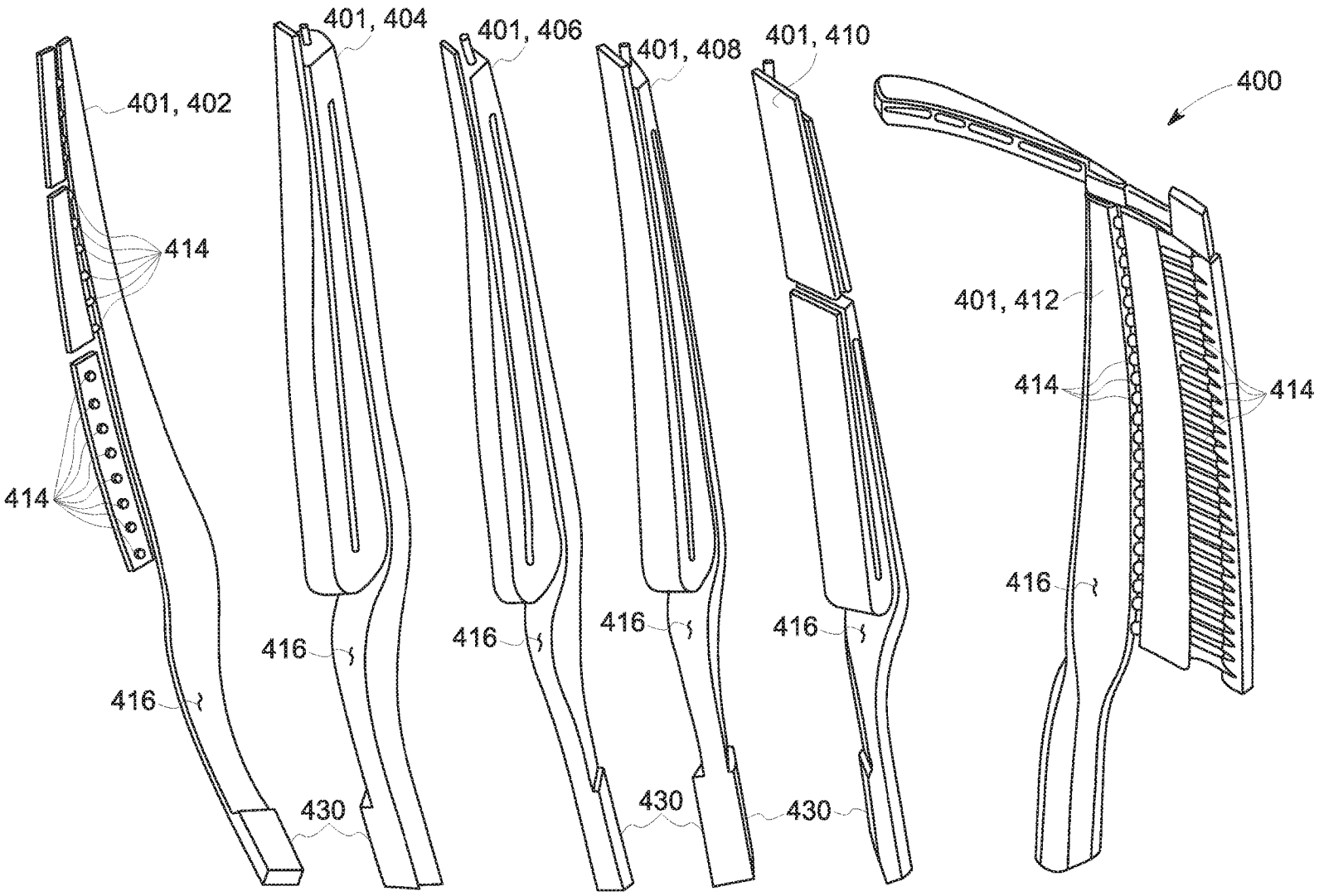
FIG. 4 is a schematic exploded perspective view of a multiple component core assembly defining a cooling circuit of the component shown in FIGS. 3 and 4.
Figure 5:
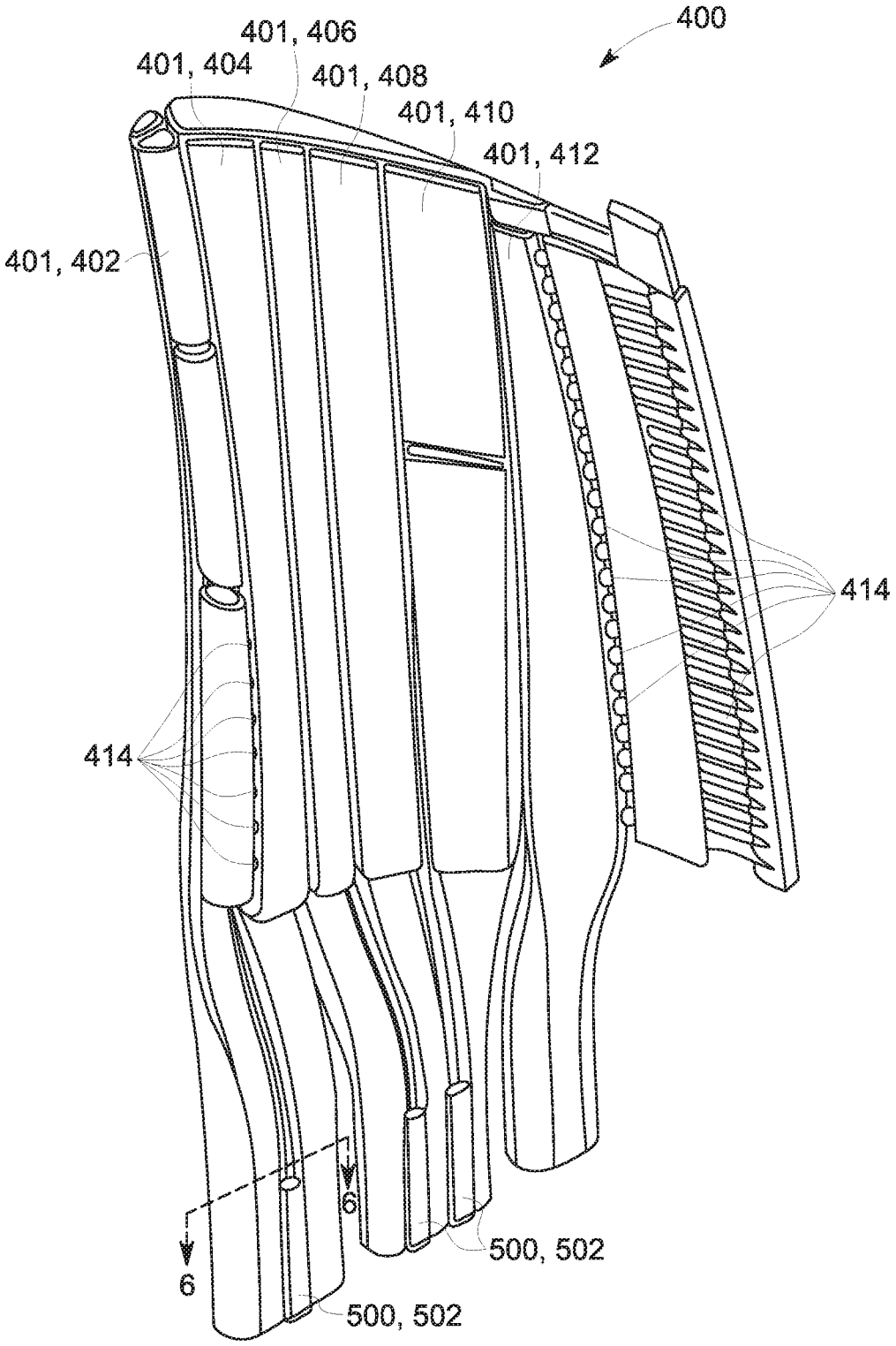
FIG. 5 is a schematic perspective view of the multiple component core assembly coupled together with exemplary core connection components.

FIG. 4 is a schematic exploded perspective view of a multiple component core assembly 400 defining at least a portion of cooling circuit 106 of component 80 (shown in FIGS. 3 and 4). FIG. 5 is a perspective view of multiple component core assembly 400 coupled together by a plurality of core connection components 500. In the exemplary embodiment, component 80 (shown in FIG. 2), in the form of rotor blade 70, or alternatively stator vane 72, is formed using an investment casting process, for example and without limitation, a lost wax investment casting process. Multiple component core assembly 400 is fabricated from a plurality of individual core components 401. For example, in the exemplary embodiment, the individual core components 401 include a leading edge core component 402, intermediate core components 404, 406, 408, and 410, and a trailing edge core component 412.

In the exemplary embodiment, core components 402, 404, 406, 408, 410, and 412 include various protrusions, for example protrusions 414 formed on leading edge core component 402 and trailing edge core component 412 that, when a casting process for forming component 80 is completed, define the plurality of apertures 102, as shown in FIG. 3.

In the exemplary embodiment, individual core components 401 are individually shaped as required in accordance with a net shape of component 80 and define respective shapes and structures conforming to portions of cooling circuit 106 of component 80, for example, plenums 110, chambers 112, and return channels 114. Thus, when the casting process for forming component 80 is completed, the voids remaining after individual core components 401 are removed define cooling circuit 106 of component 80.

In the exemplary embodiment, multiple component core assembly 400, i.e., individual core components 401, is formed from a core material 416. In the exemplary embodiment, core material 416 is a refractory ceramic material selected to withstand a high temperature environment associated with a molten or fluid state of component material 78 used to form component 80. For example and without limitation, core material 416 includes at least one of silica, alumina, and mullite. In addition, in the exemplary embodiment, core material 416 is selectively removable from component 80 to form the at least one internal void 100. For example, but not by way of limitation, core material 416 is removable from component 80 by a suitable process that does not substantially degrade component material 78, such as, but not limited to, a suitable chemical leaching process. In certain embodiments, core material 416 is selected based on a compatibility with, and/or a removability from, component material 78.

Additionally or alternatively, core material 416 is selected based on a compatibility with a connection component material 502. For example, in some such embodiments, core material 416 is selected to have a thermal expansion coefficient substantially similar to a thermal expansion coefficient of connection component material 502, such that during heating of core components 402, 404, 406, 408, 410, and 412 or multiple component core assembly 400, the core components or core assembly and core connection component 500 expand at the same rate, thereby facilitating reducing stresses, cracking, and/or other damaging of the core components or core assembly due to mismatched thermal expansion. In alternative embodiments, core material 416 is any suitable material that enables component 80 to be formed as described herein.

In the exemplary embodiment, each of core components 402, 404, 406, 408, 410, and 412, and thus multiple component core assembly 400, is formed and positioned in any suitable fashion that enables multiple component core assembly 400 to function as described herein. For example, but not by way of limitation, core material 416 is injected as a slurry into a suitable master core die (not shown) corresponding to a respective core component 402, 404, 406, 408, 410, and 412. Core material 416 is dried and fired at an elevated temperature in a separate core-forming process to form core components 402, 404, 406, 408, 410, and 412 separate from one another. In alternative embodiments, core components 402, 404, 406, 408, 410, and 412 are formed, for example, using a poured core molding process, a slip-cast molding process, or any other core forming process that enables core components 402, 404, 406, 408, 410, and 412 to be formed and function as described herein.

As illustrated in FIG. 5, individual core components 401 are stacked and coupled together to form a unitary multiple component core assembly 400. For example, core components 402, 404, 406, 408, 410, and 412 can be manually assembled using a suitable fixture or assembled by a suitable automated process. In the exemplary embodiment, one or more core connection components 500 are used to couple individual core components 401 to each other and/or couple various portions of individual core components 401 together to form the respective individual core component. For example, each individual core component 401 includes at least one coupling portion 430 configured to be received within a corresponding connection component 500. Each connection component 500 is configured to position at least one individual core component 401 with respect to another individual core component 401 when the respective coupling portions 430 are received therein. Alternatively, each connection component 500 is configured to position the at least one individual core component 401 with respect to another individual core component 401 in any suitable fashion.

In the exemplary embodiment, core connection component 500 is formed from a connection component material 502 selected to be at least partially absorbable by molten or fluid component material 78 used to form component 80. For example, in one embodiment, component material 78 is an alloy, and connection component material 502 is at least one constituent material of the alloy.

Figure 7:
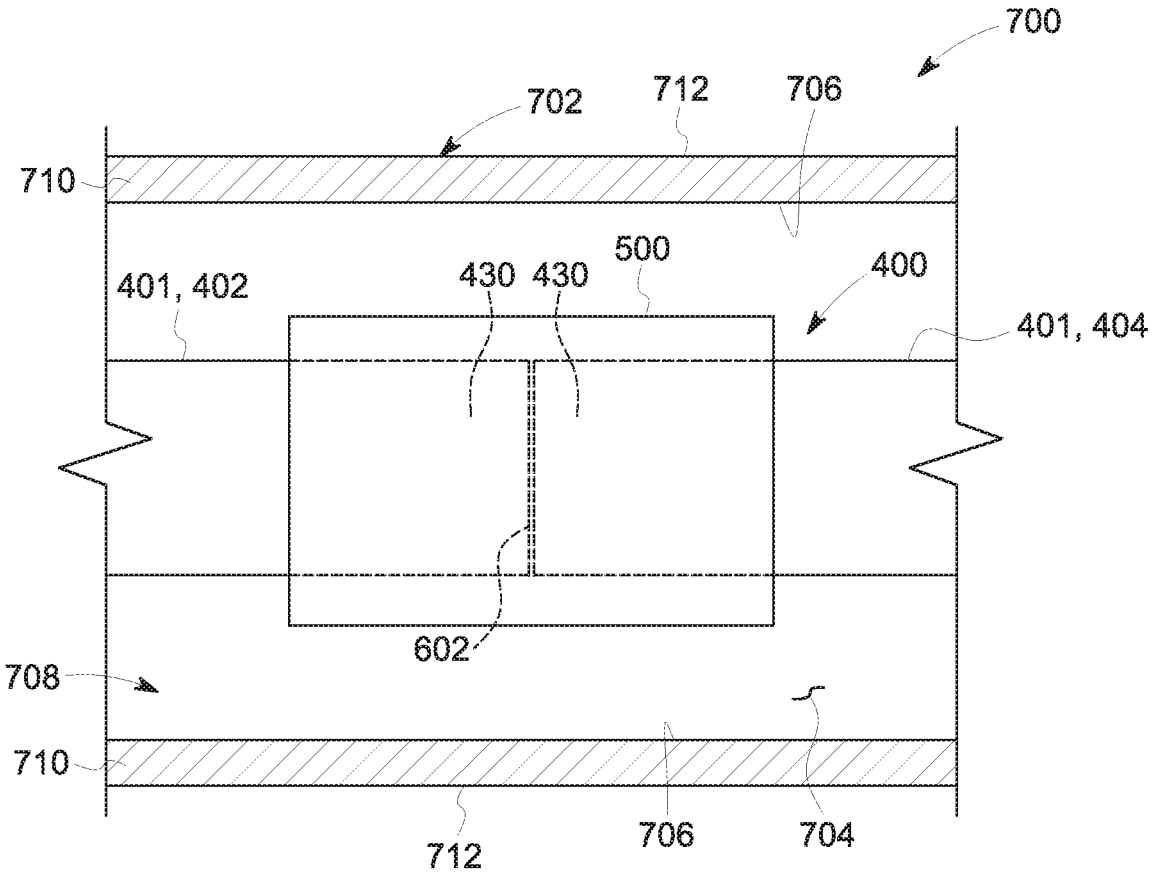
FIG. 7 is a schematic view of an exemplary mold assembly that includes the multiple component core assembly of FIGS. 4-6, and is used to form the component shown in FIG. 2.

In the exemplary embodiment, connection component material 502 is substantially nickel and component 80 is formed from a nickel-based superalloy, such that connection component material 502 is compatible with component material 78 when the material in its molten state is introduced into a mold 702 (shown in FIG. 7). In alternative embodiments, component material 78 is any suitable alloy, and connection component material 502 is at least one material that is compatible with the molten alloy. For example, in some embodiments, component material 78 is a cobalt-based superalloy, and connection component material 502 is substantially cobalt. For another example, component material 78 is an iron-based alloy, and connection component material 502 is substantially iron. For another example, component material 78 is a titanium-based alloy, and connection component material 502 is substantially titanium.

In certain embodiments, connection component material 502 is substantially absorbed by component material 78 when the component material 78 in its molten or fluid state is introduced into mold 702. For example, in some such embodiments, connection component material 502 is substantially absorbed by component material 78 such that no discrete boundary delineates connection component material 502 from component material 78 after the material is cooled. Moreover, in some such embodiments, connection component material 502 is substantially absorbed such that, after component material 78 is cooled, connection component material 502 is substantially uniformly distributed within component material 78. For example, a concentration of connection component material 502 proximate a location of connection component material 502 prior to casting component 80 is not detectably higher than a concentration of connection component material 502 at other locations within component 80. For example and without limitation, connection component material 502 is nickel and component material 78 is a nickel-based superalloy, and no detectable higher nickel concentration remains after component material 78 is cooled, resulting in a distribution of nickel that is substantially uniform throughout the nickel-based superalloy of formed component 80.

In alternative embodiments, connection component material 502 is other than substantially absorbed by component material 78. For example, in some embodiments, connection component material 502 is partially absorbed by component material 78, such that after component material 78 is cooled, connection component material 502 is other than substantially uniformly distributed within component material 78. For example, a concentration of connection component material 502 proximate a location of connection component material 502 prior to casting component 80 is detectably higher than a concentration of connection component material 502 at other locations within component 80. In some such embodiments, connection component material 502 is insubstantially absorbed, that is, at most only slightly absorbed, by component material 78 such that a discrete boundary delineates connection component material 502 from component material 78 after component material 78 is cooled. Additionally or alternatively, in some such embodiments, connection component material 502 is insubstantially absorbed by component material 78 such that at least a portion of connection component material 502 remains intact after component material 78 is cooled. For another example, connection component material 502 melts and collects at the bottom of mold 702 during a pre-heat process prior to casting or molding component 80, yielding a detectably high concentration of connection component material 502 in a portion of component 80 formed proximate the bottom of mold 702.

Figure 6:
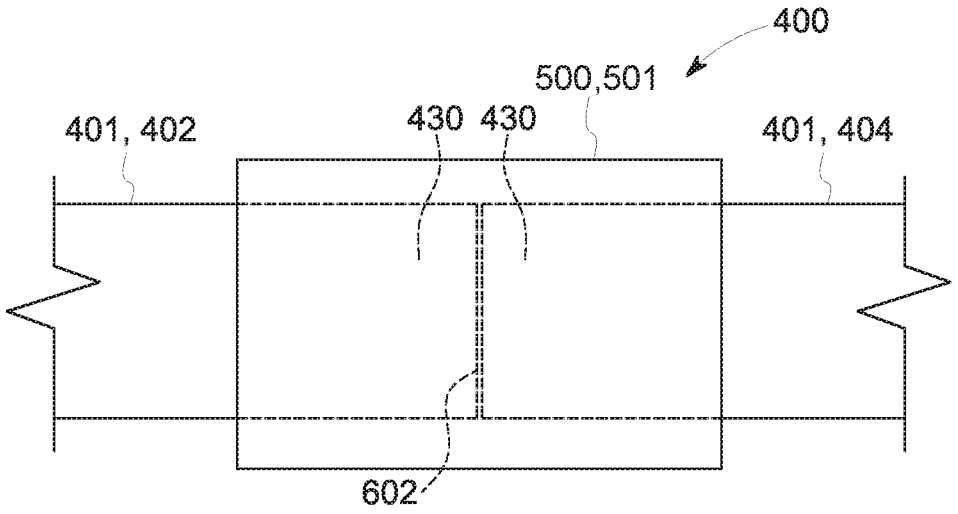
FIG. 6 is a schematic sectional view of an exemplary core split line of the exemplary multiple component core assembly of FIGS. 4 and 5, taken along line 6-6 in FIG. 5.

FIG. 6 is a schematic sectional view of an exemplary core split line 602 of multiple component core assembly 400, taken along line 6-6 in FIG. 5. As shown in FIG. 6 for example, coupling portions 430 of core components 402 and 404 are received within a respective connection component 500 and coupled together along core split line 602. While core split line 602 is shown as a standard butt joint, it is contemplated that the connection between respective individual core components 401 can be any type of joint, for example and without limitation, a dovetail joint, a half-lap joint, a tongue and groove joint, and any other suitable joint that enables multiple component core assembly 400 to be formed as described herein.

In the exemplary embodiment, core connection component 500 is a mechanical connector. The term "mechanical connector," as used herein, encompasses any structural and/or physical component for mechanically coupling two components together, such as a sheath, stamp, pin, or screw. For example, in the embodiment illustrated in FIG. 6, core connection component 500 is embodied as a sleeve 501 shaped to receive coupling portions 430 of components 402 and 404 therein, such that core components 402 and 404 are coupled together along core split line 602.

Figure 9:
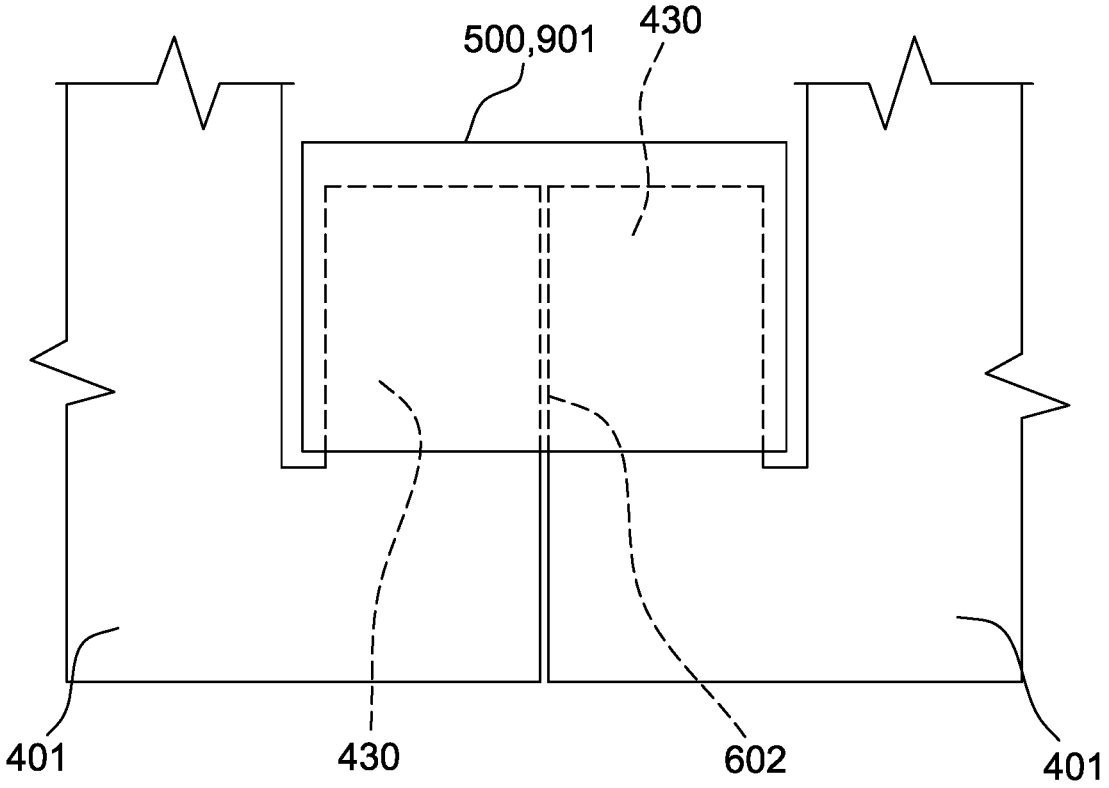
FIG. 9 is a schematic view of an alternative exemplary core split line of the exemplary multiple component core assembly of FIGS. 4 and 5.

For another example, FIG. 9 is a schematic view of an alternative exemplary core split line 602 of multiple component core assembly 400 in which coupling portions 430 of adjacent core components 401 are coupled together using core connection component 500 embodied as a sheath 901. More specifically, coupling portions 430 are shaped to define adjacent protrusions, and sheath 901 is shaped to receive the protrusions therein, such that core components 401 are coupled together along core split line 602.

Figure 10:
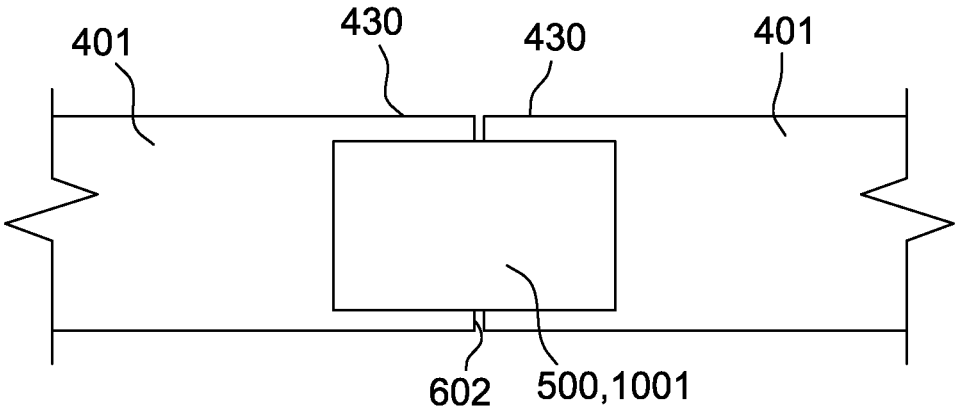
FIG. 10 is a schematic view of another alternative exemplary core split line of the exemplary multiple component core assembly of FIGS. 4 and 5.

For another example, FIG. 10 is a schematic view of an alternative exemplary core split line 602 of multiple component core assembly 400 in which coupling portions 430 of adjacent core components 401 are coupled together using core connection component 500 embodied as a stamp 1001. More specifically, stamp 1001 is configured to be mechanically stamped onto each of coupling portions 430, such that core components 401 are coupled together along core split line 602.

Figure 11:
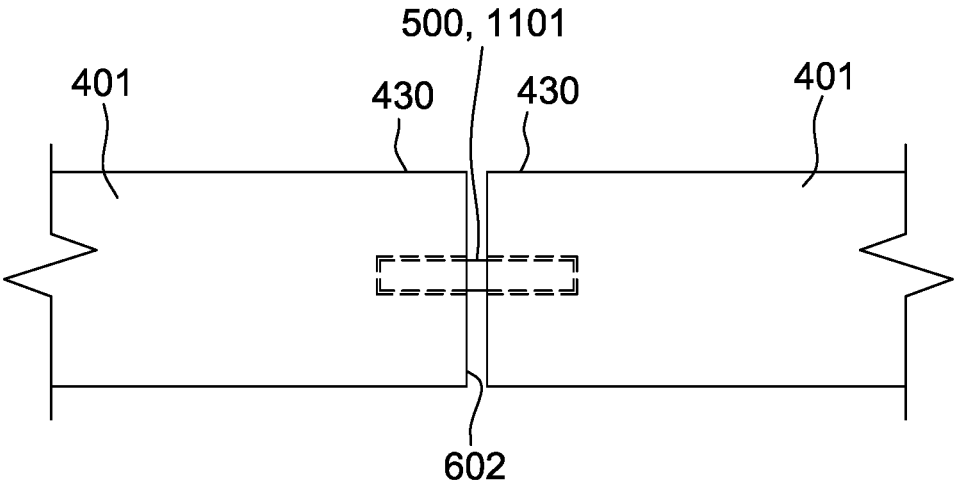
FIG. 11 is a schematic view of another alternative exemplary core split line of the exemplary multiple component core assembly of FIGS. 4 and 5.

For another example, FIG. 11 is a schematic view of an alternative exemplary core split line 602 of multiple component core assembly 400 in which coupling portions 430 of adjacent core components 401 are coupled together using core connection component 500 embodied as a pin 1101. More specifically, pin 1101 is configured to be received within each of coupling portions 430, such that core components 401 are coupled together along core split line 602.

Figure 12:
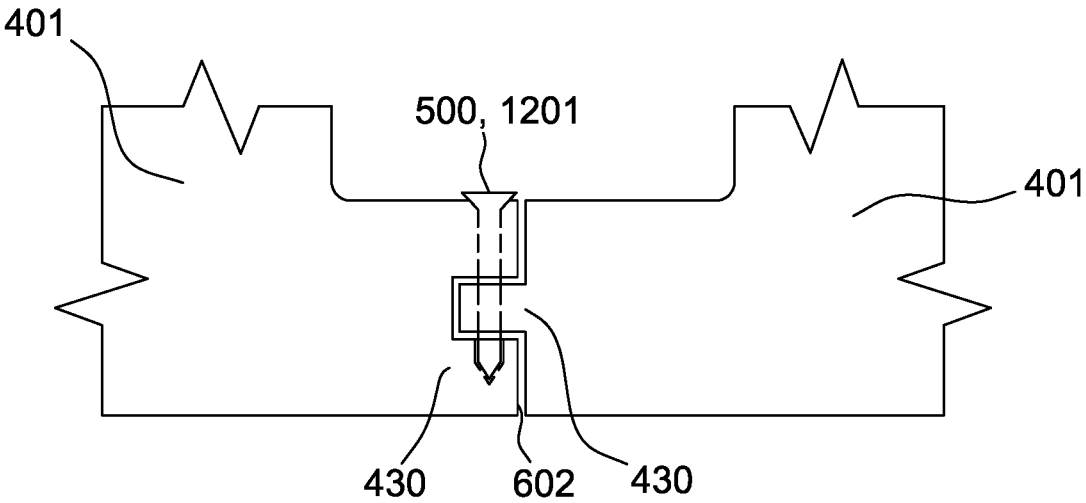
FIG. 12 is a schematic view of another alternative exemplary core split line of the exemplary multiple component core assembly of FIGS. 4 and 5.

For another example, FIG. 12 is a schematic view of an alternative exemplary core split line 602 of multiple component core assembly 400 in which coupling portions 430 of adjacent core components 401 are coupled together using core connection component 500 embodied as a screw 1201. More specifically, screw 1201 is configured to be received within each of coupling portions 430, such that core components 401 are coupled together along core split line 602.

In alternative embodiments, core connection component 500 is any other connector type that enables core connection component 500 to position individual core components 401 with respect to each other, as described herein.

Figure 13:
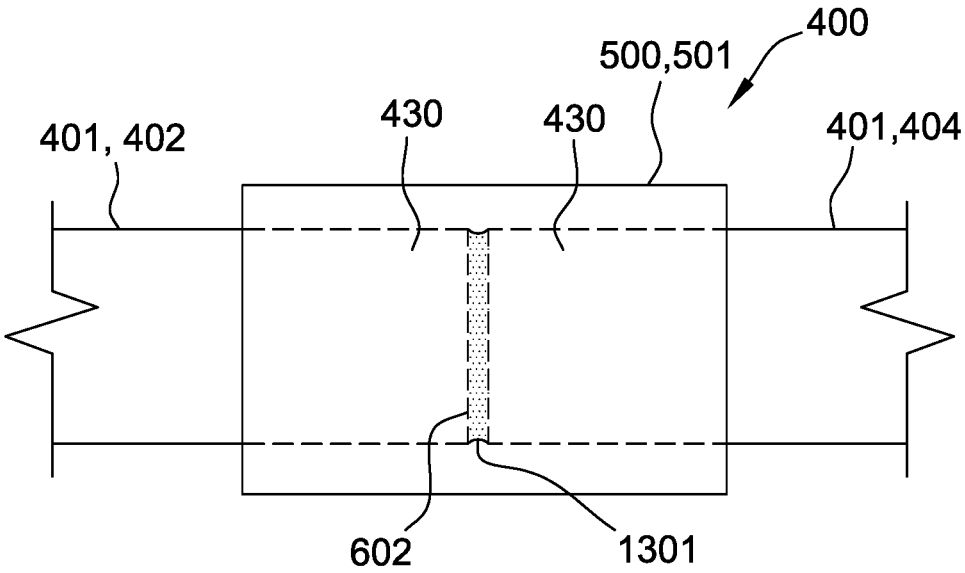
FIG. 13 is a schematic view of another alternative exemplary core split line of the exemplary multiple component core assembly of FIGS. 4 and 5.

In certain embodiments, a chemical connector 1301 is used in addition to core connection component 500 to further secure individual core components 401 along core split line 602. The term "chemical connector" as used herein is a substance that bonds adjacent surfaces of two components together, such as an adhesive or braze. For example, FIG. 13 is a schematic view of an alternative exemplary core split line 602 of multiple component core assembly 400 in which coupling portions 430 of adjacent core components 401 are coupled together using core connection component 500 embodied as sleeve 501, as shown in FIG. 6, and also using chemical connector 1301 embodied as an adhesive. Alternatively, chemical connector 1301 is any suitable chemical connector. In the exemplary embodiment, chemical connector 1301 is formed from a material selected to be compatible with molten or fluid component material 78 used to form component 80. In some embodiments, chemical connector 1301 facilitates stabilizing a position of core components 401 with respect to each other, such as during a process of forming mold 702 (shown in FIG. 7). Alternatively, chemical connector 1301 is not used at core split line 602.

In certain embodiments, core connection component 500 structurally reinforces multiple component core assembly 400, and in particular, connections along the core split lines, for example core split line 602 between core component 402 and core component 404. Thus core connection component 500 facilitates reducing potential problems that would be associated with production, handling, and use of an unreinforced multiple component core assembly 400 in some embodiments.

For example, in certain embodiments, multiple component core assembly 400 is a relatively brittle ceramic material subject to a relatively high risk of fracture, cracking, and/or other damage due, in part, to the intricately-shaped features that define the voids and internal passages of component 80. Thus, in some such embodiments, forming and assembling separate individual core components 401, such as core components 402, 404, 406, 408, 410, and 412, using core connection components 500 presents a much lower risk of damage to multiple component core assembly 400, as compared to using a single core component corresponding to multiple component core assembly 400. Similarly, in some such embodiments, forming mold 702 (shown in FIG. 7) around multiple component core assembly 400, such as by repeated investment of multiple component core assembly 400 in a slurry of mold material, presents a lower risk of damage to multiple component core assembly 400, as compared to using a single core component corresponding to multiple component core assembly 400. Thus, in certain embodiments, use of multiple component core assembly 400 with core connection components 500 presents a lower risk of failure to produce an acceptable component 80, as compared to forming component 80 using a single core component corresponding to multiple component core assembly 400. In addition, because connection component material 502 is absorbable by component material 78 when component 80 is cast, the use of connection component 500 reduces a time and complexity of the component casting process as compared to, for example, using pins that must be removed prior to casting to position individual core components 401 with respect to each other and/or mold 702.

In certain embodiments, core components 401 are positioned with respect to each other in a preselected orientation, such as using external fixtures (not shown), and a preformed core connection component 500 is coupled to at least two of the core components 401 to form multiple component core assembly 400. In other embodiments, core components 401 are positioned with respect to each other in a preselected orientation, such as using external fixtures (not shown), and core connection component 500 is formed in place around at least two of the core components 401, such as by using a suitable deposition process. For example, with reference again to FIG. 6, core connection component 500 is formed on at least a portion of the surfaces of coupling portions 430 of two adjacent core components 401 by a plating process, such that connection component material 502 is deposited on coupling portions 430 until a selected thickness of core connection component 500 is achieved. Application of connection component material 502 to other surfaces of core components 401 is inhibited using any suitable method, for example by masking of such other surfaces.

For example, connection component material 502 is a metal, and is deposited on coupling portions 430 in a suitable metal plating process. In some such embodiments, connection component material 502 is deposited on coupling portions 430 in an electroless plating process. Additionally or alternatively, connection component material 502 is deposited on coupling portions 430 in an electroplating process. In alternative embodiments, connection component material 502 is any suitable material, and core connection component 500 is formed on coupling portions 430 by any suitable plating process that enables core connection component 500 to function as described herein.

In some such embodiments, connection component material 502 includes a plurality of materials disposed on coupling portions 430 in successive layers. For example, coupling portions 430 are formed from a ceramic material, an initial layer of connection component material 502 is a first metal alloy selected to facilitate electroless plating deposition onto coupling portions 430, and a subsequent layer of connection component material 502 is a second metal alloy selected to facilitate electroplating to the prior layer of connection component material 502. In some such embodiments, the first and second metal alloys are alloys of nickel. In other embodiments, coupling portions 430 are formed from any suitable material, connection component material 502 is any suitable plurality of materials, and core connection component 500 is formed on coupling portions 430 by any suitable process that enables core connection component 500 to function as described herein.

FIG. 7 is a schematic view of an exemplary mold assembly 700 that includes multiple component core assembly 400 and is used to form component 80 shown in FIG. 1. In the exemplary embodiment, mold assembly 700 includes multiple component core assembly 400 positioned with respect to mold 702. An interior wall 706 of mold 702 defines a mold cavity 708 within mold 702, and multiple component core assembly 400 is at least partially received in mold cavity 708. More specifically, interior wall 706 defines a shape corresponding to an exterior shape of component 80, such that multiple component core assembly 400, which has a shape corresponding to cooling circuit 106 of component 80, is positioned in a spaced relationship with interior wall 706.

In the exemplary embodiment, mold 702 is formed from a mold material 710. For example in the exemplary embodiment, mold material 710 is a refractory ceramic material selected to withstand a high temperature environment associated with the molten or fluid state of component material 78. In alternative embodiments, mold material 710 is any suitable material that enables component 80 to be formed as described herein. Moreover, in the exemplary embodiment, mold 702 is formed by a suitable investment process.

For example and without limitation, component 80 is formed using a lost wax investment casting process. Multiple component core assembly 400 is encased in pattern material, such as a wax 704, that is shaped to conform to a desired configuration of component 80. Wax 704, including multiple component core assembly 400 at least partially encased therein, is then repeatedly dipped into a slurry of mold material 710, which is allowed to harden to create a shell 712 of mold material 710, and shell 712 is fired to form mold 702. In alternative embodiments, mold 702 is formed by any suitable method that enables mold 702 to function as described herein. In the exemplary embodiment, during firing of shell 712, wax 704 is melted out of shell 712, such that the remaining mold 702 includes multiple component core assembly 400, external ceramic shell 712, and mold cavity 708, which was previously filled with wax 704, defined therebetween. Mold cavity 708 is then filled with molten component material 78 to form component 80. In some embodiments, connection component material 502 of core connection component 500 is substantially absorbed by the molten component material 78 used to form component 80, while in other embodiments, for example, core connection component 500 remains at least partially intact adjacent component material 78 within mold cavity 708, as described herein.

In the exemplary embodiment, after component material 78 cools and solidifies in mold cavity 708, shell 712 is removed to expose component material 78 that has taken the shape of mold cavity 708, i.e., component 80. Multiple component core assembly 400 is removed from component 80 to form the cooling circuit 106 therein. For example, but not by way of limitation, core material 416 is removed from component 80 using a chemical leaching process.

Moreover, after removal of core material 416 from component 80, there may be small portions of component material 78 extending into cooling circuit 106, i.e., plenums 110, chambers 112, and return channels 114 of component 80, at locations corresponding to core split lines 602 defined between core components 402, 404, 406, 408, 410, and 412, for example. These small portions of component material 78, or casting bridges, are removed from cooling circuit 106 using any tooling processes, for example and without limitation, drilling, wire electrical discharge machining (EDM), electrochemical machining, milling, and any other tooling process that enables excess component material 78 to be removed from cooling circuit 106 as described herein.

Figure 8:
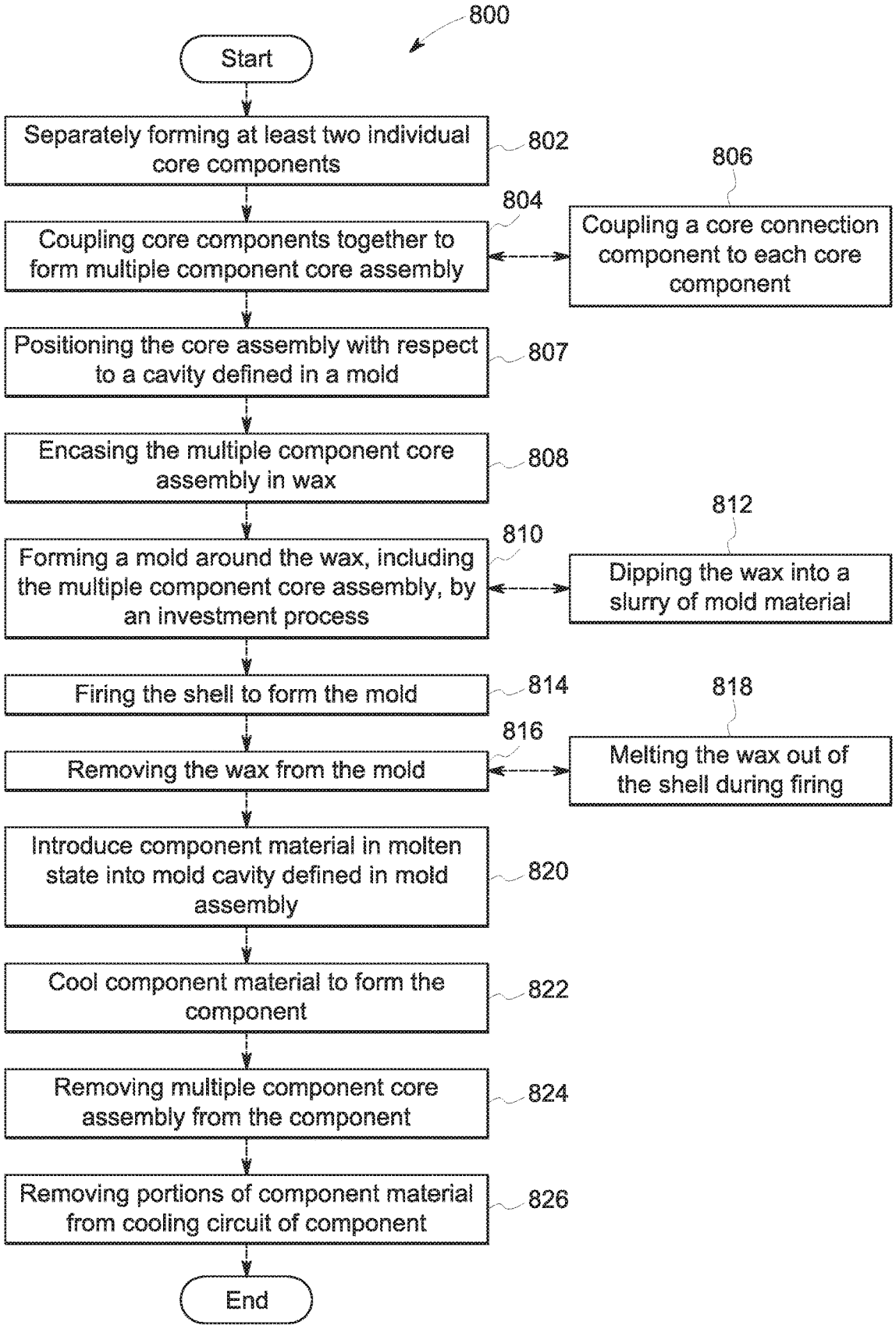
FIG. 8 is a flow diagram of an exemplary method of forming the component shown in FIG. 2.

An exemplary method 800 of forming a component, such as component 80, is illustrated in a flow diagram in FIG. 8. With reference also to FIGS. 1-7, exemplary method 800 includes separately forming 802 at least two individual core components 401, for example, one or more of core components 402, 404, 406, 408, 410, and 412, using any core forming process, such as injecting a slurry of a core material into a respective master core die. Additionally, method 800 further includes coupling 804 at least two core components, e.g. core components 402 and 404, together to form multiple component core assembly 400. For example, the step of coupling 804 at least two core components together further includes coupling 806 core connection component 500 to each of the at least two core components using a mechanical connection, as described herein.

Furthermore, method 800 includes positioning 807 multiple component core assembly 400 with respect to mold cavity 708 defined in a mold 702. In addition, method 800 includes encasing 808 multiple component core assembly 400 in a pattern material, such as wax 704, where the pattern material is shaped to conform to a desired configuration of component 80, or at least portions thereof.

In the exemplary embodiment, method 800 includes forming 810 a shell 712 around wax 704, including multiple component core assembly 400, by an investment process, as described herein. For example, the step of forming 810 shell 712 includes repeatedly dipping 812 wax 704 into a slurry of mold material 710, which is allowed to harden to create the shell 712 of mold material 710. In addition, method 800 includes firing 814 shell 712 to form mold 702.

Method 800 further includes removing 816 wax 704 from mold 702. In one embodiment of method 800, removing 816 wax 704 includes melting 818 wax 704 out of shell 712 during firing of shell 712, so that the remaining mold 702 includes multiple component core assembly 400, external ceramic shell 712, and mold cavity 708.

In addition, method 800 includes introducing 820 a component material, such as component material 78 used to form component 80, in a molten or fluid state into mold cavity 708 defined in mold assembly 700, such that core connection component 500 is at least partially absorbed by component material 78, as described herein. Mold assembly 700 includes multiple component core assembly 400 positioned with respect to mold 702, interior wall 706, and mold cavity 708 defined by interior wall 706 which is left behind after removal of wax 704. Multiple component core assembly 400 is coupled in a spaced relationship with respect to interior wall 706.

Method 800 also includes cooling 822 component material 78 used to form component 80. Interior wall 706 and multiple component core assembly 400 cooperate to define the shape of component 80.

In addition, method 800 includes removing 824 multiple component core assembly 400 from component 80 to form cooling circuit 106 therein. For example, but not by way of limitation, core material 416 is removed from component 80 using a chemical leaching process. Additionally, in some embodiments of method 800, the method includes removing 826 small portions of component material 78, such as casting bridges corresponding to the core split line, from cooling circuit 106 of component 80 left behind after the removal of multiple component core assembly 400. The casting bridges may be removed using any tooling processes, for example and without limitation, drilling, wire electrical discharge machining (EDM), electrochemical machining, milling, and any other tooling process that enables excess component material 78 to be removed from cooling circuit 106 as described herein.

The above-described embodiments of multiple component core assemblies, mold assemblies, and methods enable fabricating hot gas path components or other suitable components with improved precision and repeatability as compared to at least some known mold assemblies and methods. Specifically, the multiple component core assembly includes at least two individual core components coupled together using at least one core connection component. The core connection component enables the complete core to be formed from smaller individual core portions that are less susceptible to damage than a unitary complete core, and protects the multiple component core assembly from damage during forming and firing of the mold. Also specifically, the use of the core connection component in forming the multiple component core assembly facilitates reducing a time and cost of preparing the mold assembly for prototyping or production operations, for example by reducing or eliminating a need for locating pins in the mold assembly that must be removed prior to casting the component. In some cases, the above-described embodiments enable formation of components having structures that cannot be precisely and/or repeatably formed using other known mold assemblies and methods.

An exemplary technical effect of the methods, systems, and apparatus described herein includes at least one of: (a) reducing or eliminating fragility problems associated with forming, handling, transport, and/or storage of a core used in forming a component; (b) improving precision and repeatability of formation of components having intricate internal voids and structures; and (c) enabling increased speed in design iterations by rapidly forming intricate cores and casting components having intricate internal voids and structures.

Exemplary embodiments of multiple component core assemblies and methods including such core assemblies are described above in detail. The multiple component cores assemblies, and methods using such core assemblies, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use investment casting mold assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A mold assembly for forming a component from a component material, said mold assembly comprising:

a mold comprising an interior wall that defines a mold cavity within said mold, said mold cavity configured to receive the component material in a molten state therein; and a core assembly positioned inside said mold, said core assembly comprising:

a first core component;

a second core component separate from said first core component; and a core connection component coupled to said first core component and said second core component, said core connection component formed from a connection component material configured to be absorbable by the component material and comprising a sleeve shaped to receive coupling portions of said first core component and said second core component, wherein said first core component is coupled adjacent said second core component at a core split line defining a contacting joint therebetween.

2. The mold assembly in accordance with claim 1, wherein at least one of said first core component and said second core component is fabricated from a core material different than said connection component material.

3. The mold assembly in accordance with claim 2, wherein said core material and said connection component material comprise a substantially similar thermal expansion coefficient.

4. The mold assembly in accordance with claim 2, wherein said core material is selected from the group consisting of silica, alumina, and mullite.

5. The mold assembly in accordance with claim 2, wherein said connection component material is selected from the group consisting of nickel, cobalt, iron, and titanium.

6. The mold assembly in accordance with claim 1, wherein said core connection component is a mechanical connector configured to couple said first core component and said second core component together.

7. The mold assembly in accordance with claim 6, wherein said core connection component further comprises one or more of the following: a sheath connector, a stamp connector, a pin connector, and a screw connector.

8. The mold assembly in accordance with claim 1, wherein said core connection component is configured to receive at least a portion of said first core component and at least a portion of said second core component therein.

9. The mold assembly in accordance with claim 1, wherein the core connection component is a chemical connector configured to couple said first core component and said second core component together.

10. The mold assembly in accordance with claim 9, wherein the chemical connector is a braze.

11. The mold assembly in accordance with claim 9, wherein the chemical connector is an adhesive.

12. The mold assembly in accordance with claim 1, wherein the core connection component comprises a mechanical connector and a chemical connector configured to couple said first core component and said second core component together.

13. The mold assembly in accordance with claim 1, wherein the connection component material comprises a plurality of materials disposed in successive layers on coupling portions of the first core component and the second core component.

14. The mold assembly in accordance with claim 13, wherein the plurality of materials comprises a first metal alloy and a second metal alloy.

* * * * *